US006029491A

United States Patent [19]

Ginzburg

[11] Patent Number: 6,029,491

[45] Date of Patent: Feb. 29, 2000

[54] CONTINOUS SPIRAL MOTION AND ROLL BENDING SYSTEM FOR ROLLING MILLS

[75] Inventor: Vladimir B. Ginzburg, Pittsburgh, Pa.

[73] Assignees: Danieli United, Cranberry Twp.; International Rolling Mill Consultants, Inc., Pittsburgh, both of Pa.

[21] Appl. No.: 09/301,281

[22] Filed: Apr. 28, 1999

Related U.S. Application Data

[63] Continuation-in-part of application No. 09/113,997, Jul. 10, 1998.

[51] Int. Cl.[7] ..... B21B 31/07

[52] U.S. Cl. ..... 72/247; 72/236; 72/241.8; 72/10.6; 72/14.5; 72/365.2

[58] Field of Search ..... 72/10.1, 10.4, 72/10.6, 13.4, 14.4, 14.5, 28.2, 40, 200, 236, 237, 241.8, 245, 247, 248, 365.2; 451/49, 160, 425

[56] References Cited

U.S. PATENT DOCUMENTS

| | | | |
|---|---|---|---|
| 4,491,005 | 1/1985 | Kimura et al. | 72/201 |
| 4,548,064 | 10/1985 | Bohenkamp | 72/236 |
| 4,627,260 | 12/1986 | Benz | 72/247 |
| 4,711,116 | 12/1987 | Bald | 72/366 |
| 4,841,675 | 6/1989 | Pernecky | 72/236 |
| 4,864,836 | 9/1989 | Ochiai | 72/8 |
| 4,898,014 | 2/1990 | Ginzburg et al. | 72/247 |
| 4,934,166 | 6/1990 | Giacomoni | 72/247 |
| 4,955,221 | 9/1990 | Feldmann et al. | 72/247 |
| 4,978,583 | 12/1990 | Wakui et al. | 428/600 |
| 5,165,266 | 11/1992 | Ginzburg | 72/20 |
| 5,174,144 | 12/1992 | Kajiwara et al. | 72/236 |
| 5,596,898 | 1/1997 | Drigani et al. | 72/236 |
| 5,640,866 | 6/1997 | Satoh et al. | 72/12.7 |
| 5,655,398 | 8/1997 | Ginzburg | 72/247 |
| 5,666,842 | 9/1997 | Komatsubara et al. | 72/200 |
| 5,722,876 | 3/1998 | Mori et al. | 451/10 |
| 5,924,319 | 7/1999 | Ginzburg | 72/247 |

*Primary Examiner*—Ed Tolan

*Attorney, Agent, or Firm*—Armstrong, Westerman, Hattori, McLeland & Naughton

[57] ABSTRACT

A system and method for extending work roll useful life and controlling workpiece profile during thickness gauge reduction of continuous metal strip by axially shifting rotating work rolls during rolling, applying work roll bending forces at locations for maximum leverage and enabling work roll dressing apparatus to be located such that detrimental strip processing conditions of the working zone are not encountering by the dressing apparatus; shortening of work roll length is made possible by the location of the dressing apparatus.

17 Claims, 6 Drawing Sheets

CONTINOUS SPIRAL MOTION AND ROLL BENDING SYSTEM FOR ROLLING MILLS

This application is a continuation-in-part of U.S. patent application Ser. No. 09/113,997, filed Jul. 10th, 1998.

FIELD OF THE INVENTION

This invention relates to rolling of elongated continuous strip metal workpieces in a rolling mill stand, wherein during rolling, work rolls are shifted along their longitudinal axes and bending forces are applied through work roll chocks. On-line work roll dressing is performed outside the working zone of the rolling mill stand.

DESCRIPTION OF RELATED ART

In prior practice rolling mills for thickness gauge reduction of continuous strip metal the tonnage of product processed between work roll changes or work roll dressing is limited due to roll wear, roll marks or other roll deterioration. To reduce such roll deterioration, work roll shifting in an axial direction is provided. Additionally, to control workpiece cross-sectional profile, work roll bending and work roll crossing is provided. Patents exemplifying such prior practice procedures include: U.S. Pat. Nos. 4,491,005; 4,711,116; 4,864,836; 4,898,014; 4,934,166; 4,955,221; 5,640,866 and 5,655,398.

Prior practice rolling mills also use on-line roll surface dressing apparatus located within the working zone intermediate operator-side and drive-side housing posts of the rolling mill stand. At such working zone location, dressing operations are carried out in an unfavorable atmosphere presenting high temperatures and corrosive or undesirable fluids; operator accessibility is limited and thermal crown fluctuations interfere with dimensional accuracy of the grinding.

Work roll bending means, in such prior practice mills, are stationary and located within or adjacent outwardly of housing posts of the rolling mill stand.

SUMMARY OF THE INVENTION

A rolling mill of the present invention, for thickness gauge reduction of continuous strip metal, utilizes work roll shifting, work roll bending and on-line dressing of work roll surfaces. The invention enables work roll bending forces to be applied through associated work roll chocks which move laterally with the work rolls during work roll shifting in the direction of each rolls longitudinal axis. Such location for applying the bending forces increases leverage for roll bending compared with prior practice location for applying bending forces. Increased leverage enables reduction of bending force resulting in increased life of work roll bearings.

Applying bending forces at such locations, outside the mill housing posts, facilitates positioning roll dressing apparatus nearer a central plane of the rolling mill which enables use of shorter work rolls.

The rolling mill system includes controls to accurately position components of the roll bending apparatus for improved operation. Such work roll axial shifting concurrent with work roll rotation about its longitudinal axis is referred to as a continuous spiral motion rolling system and is described in more detail in parent case, Ser. No. 09/113,997 which is incorporated herein by reference.

BRIEF DESCRIPTION OF THE DRAWINGS

Specific features of the invention are described in more detail with reference being made to the accompanying drawings. In the drawings.

DETAILED DESCRIPTION OF THE INVENTION

Figure 1:
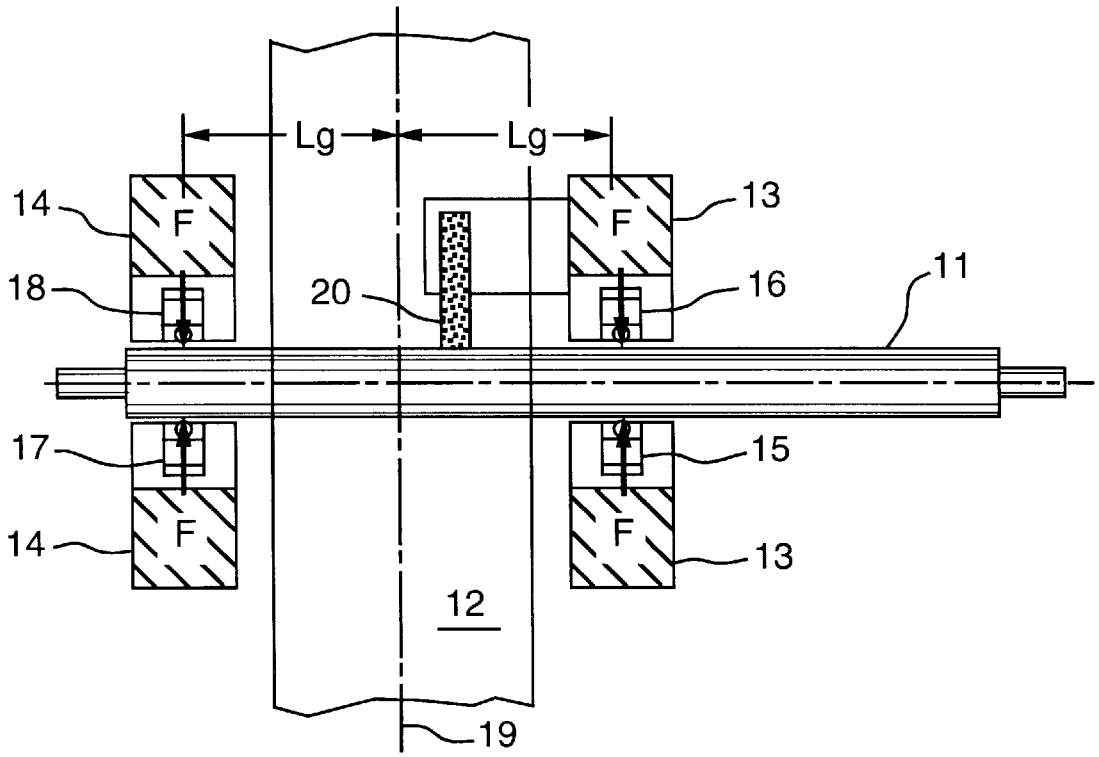
FIG. 1 Prior Art
FIG. 1 is a front elevational view in partial cross section of a prior art rolling mill having axially shifting work rolls and a work roll surface grinder.

In the following description a four high rolling mill is used to describe the invention; such example does not limit the invention to such configuration or number of rolls. FIG. 1 depicts a prior art rolling mill wherein upper work roll 11 of a length substantially greater than a width of elongated continuous metal strip 12 is generally supported by mill housing posts 13 and 14. Work roll benders are located at 15, 16, 17 and 18 for applying force F to work roll 11 to achieve roll bending for purposes of continuous strip profiling. A similar arrangement is provided for a lower work roll of the mill (Not shown). Force F has a lever length $L_g$ measured from plane 19, which is centrally located in the mill, to the location at which the bending force is applied. Grinder 20 for dressing the surface of work roll 11 is positioned in a space bounded, in the lateral direction, by mill housing posts 13 and 14. Such grinder is within a "working zone" of the rolling mill.

FIGS. 2–6, depicting differing embodiments of the invention, present similar mill housing posts 13 and 14, continuous strip 12 and rolling mill central plane 19.

Figure 2:
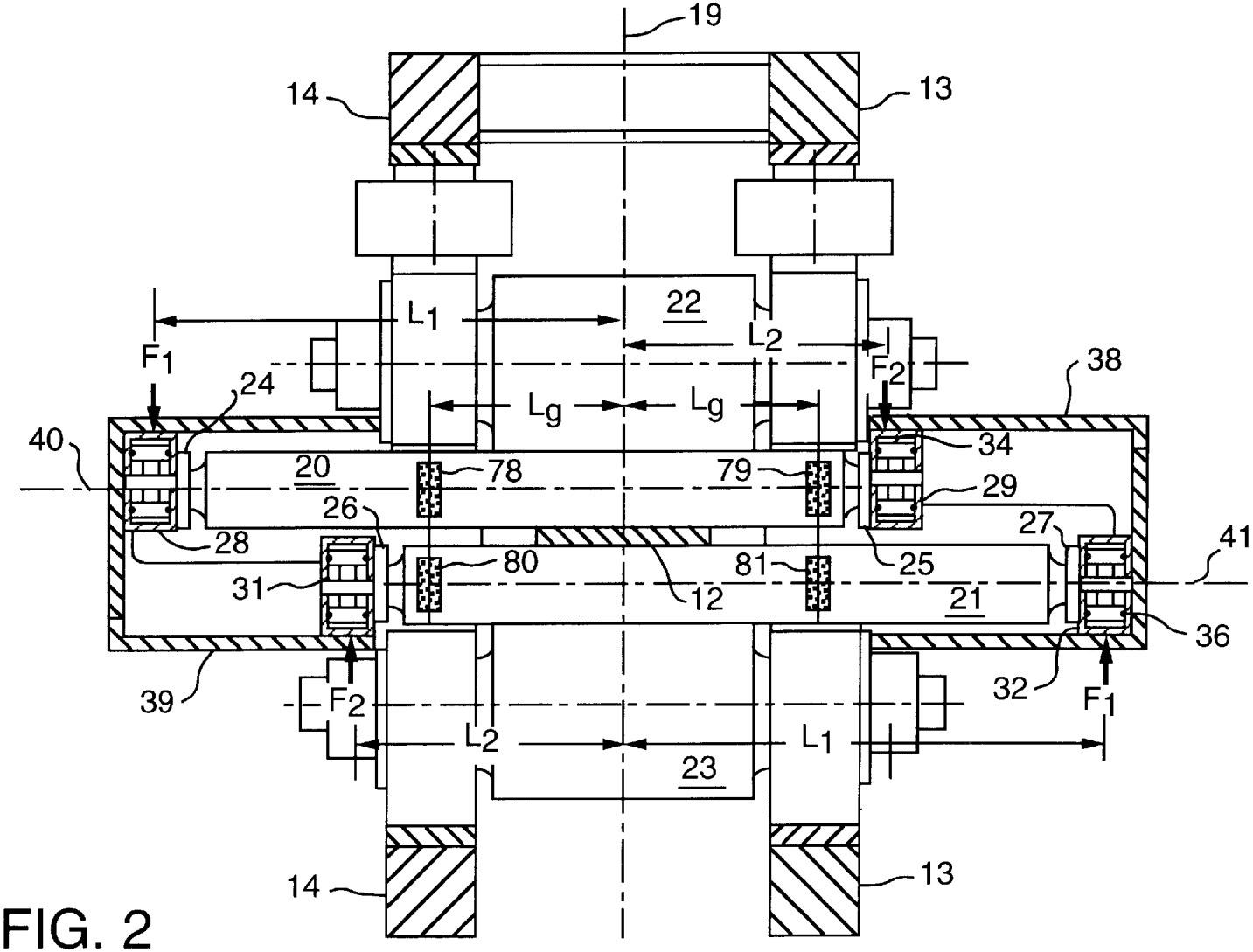
FIG. 2 is a front elevational view in partial cross section of a rolling mill of the invention featuring laterally displaceable work roll bending cylinders.
Figure 3:
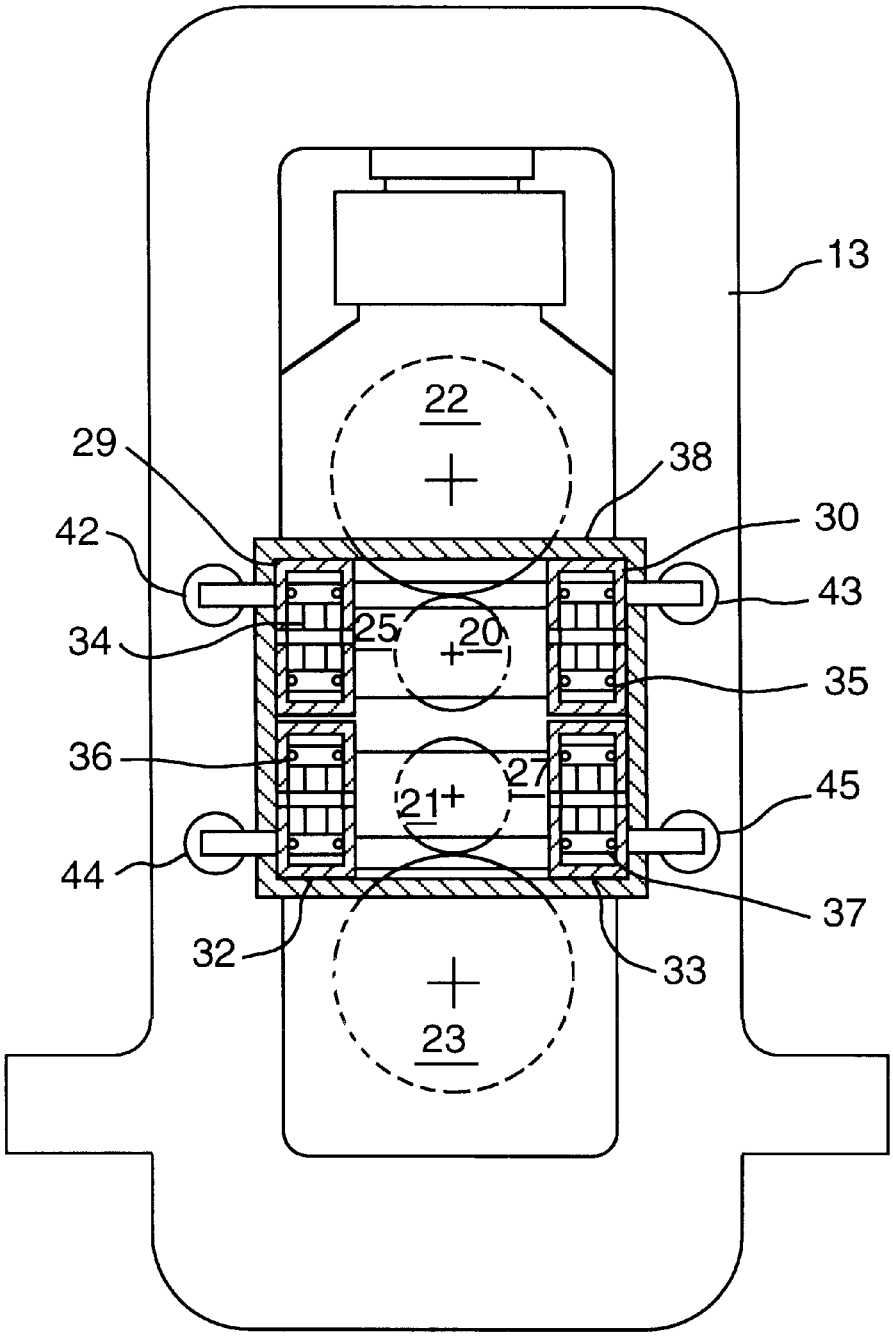
FIG. 3 is a side elevational view of the rolling mill depicted in FIG. 2.

FIGS. 2 and 3 depict an embodiment of the invention wherein work roll bending forces are applied at each end of upper work roll 20 and at each end of lower work roll 21. Such work rolls have a length substantially greater than a width of metal strip 12. Each work roll has an associated back up roll, 22 and 23 respectively. Work rolls 20 and 21, are supported at each of their ends by roll chocks 24, 25 and 26, 27 respectively, having bearing surfaces within the chocks for low-friction rotation of the rolls. Associated with each chock is a pair of block housings for housing roll bending hydraulic cylinder assemblies consisting of cylinders and pistons. Such block housings are indicated at 28 for chock 24, 29 and 30 for chock 25, 31 for chock 26, and 32 and 33 for chock 27; solely one housing is indicated for chocks 24 and 26 as each remaining housing of each pair is not visible in FIG. 2 or 3. The hydraulic cylinder assemblies, as best seen in FIG. 3, are indicated at 34 and 35 for chock 25 and at 36 and 37 for chock 27. FIG. 3 provides an enlarged side elevational view, wherein, for example, upper work roll 20 is supported by chock 25, and block housings 29 and 30, associated with chock 25, house hydraulic cylinder assemblies 34 and 35 respectively. Block housings are slideably engaged on retainers 38 and 39 which are best seen in FIG. 2. Each end of each work roll presents such just described roll bending apparatus. Each hydraulic cylinder assembly can include multiple pistons and cylinders for exerting bending force for both positive and negative roll bending in a vertical plane defined by work roll axes 40 and 41.

In operation of the rolling mill, for thickness gauge reduction of continuous strip metal 12, each work roll 20 and 21 shifts laterally in the direction of its longitudinal axis. Longitudinal axes of upper and lower work rolls 20 and 21 are indicated at 40 and 41 respectively in FIG. 2. Such axial shifting takes place concurrently with rotation of each roll about its longitudinal axis. To provide cross-sectional profiling of the continuous strip being processed, bending of work rolls 20 and 21 is carried out. Forces for such bending are indicated by $F_1$ and $F_2$ in FIG. 2 and are exerted by the action of hydraulic cylinder assemblies such as 34 and 35 (FIG. 3) for chock 25. Such cylinder assemblies bear on associated roll chocks and associated blocks housing such cylinder assemblies. Each housing block is slideably engaged and bears on its associated retainer for example blocks 29, 30, 32, and 33 on retainer 38. Such bending assemblies enable application of the bending forces solely through a centerline of each roll bearing within each roll chock. Such centerline location for application of force is preferred for increased performance and longevity of the bearings.

An additional advantage of applying bending forces at ends of each work roll is an increase, over prior practice, of lever length indicated by $L_1$ and $L_2$. Such length is measured, as described above in reference to FIG. 1, from the point at which force is applied, to the centrally located plane 19 of the rolling mill. Lever lengths $L_1$ and $L_2$ are contrasted with shorter lever length $L_g$ which is realized in prior art rolling mills such as that depicted in FIG. 1. As depicted in FIG. 2, roll bending force $F_1$ is applied through lever length $L_1$ to a left end of upper work roll 20 and to a right end of lower work roll 21. Since lever length $L_1$ is substantially the same at each location, the applied force at each such end is substantially the same. A similar condition is present for $F_2$ and $L_2$ at a right end of upper work roll 20 and a left end of lower work roll 21. Such increase in lever length enables a decrease in force required for roll bending. Decreased force results in an increase in bearing life. Although the invention is described as shown with equal axial shifting of the upper and lower work rolls in opposing directions, shifting of differing amounts, in relation to central plane 19, is not ruled out by the invention.

In the present embodiment, flexible hydraulic fluid lines can be used for connection to the hydraulic cylinder assemblies so as to enable displacement laterally with the axial shifting of the work rolls during strip processing. Means for providing lateral displacement of the bending assemblies are depicted in FIG. 3 at 42, 43, 44 and 45. In a preferred embodiment of the invention long-stroke hydraulic cylinders are used at those locations for such lateral displacement.

Figure 4:
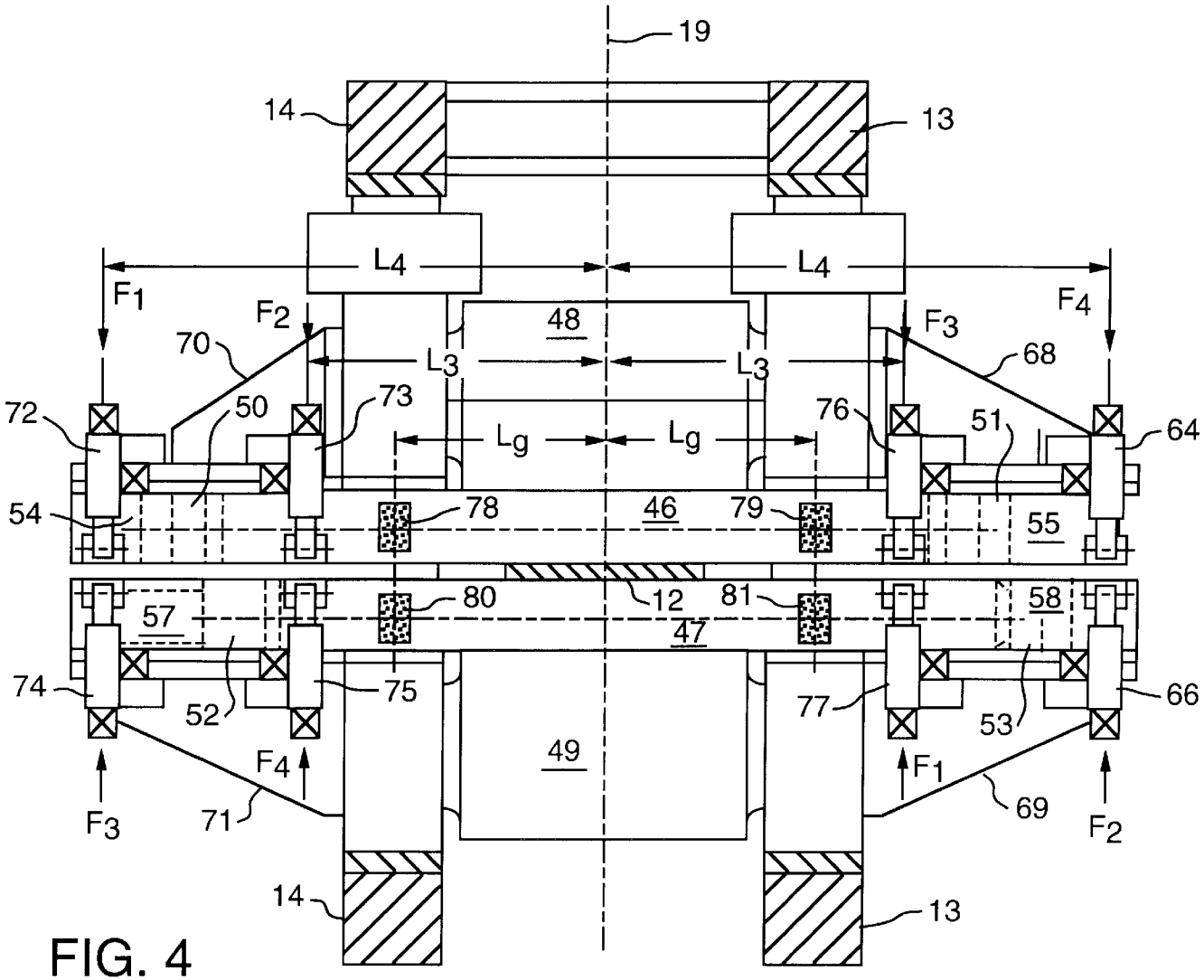
FIG. 4 is a front elevational view in partial cross section of another embodiment of the invention wherein work roll bending cylinders are stationary in relation to lateral displacement.
Figure 5:
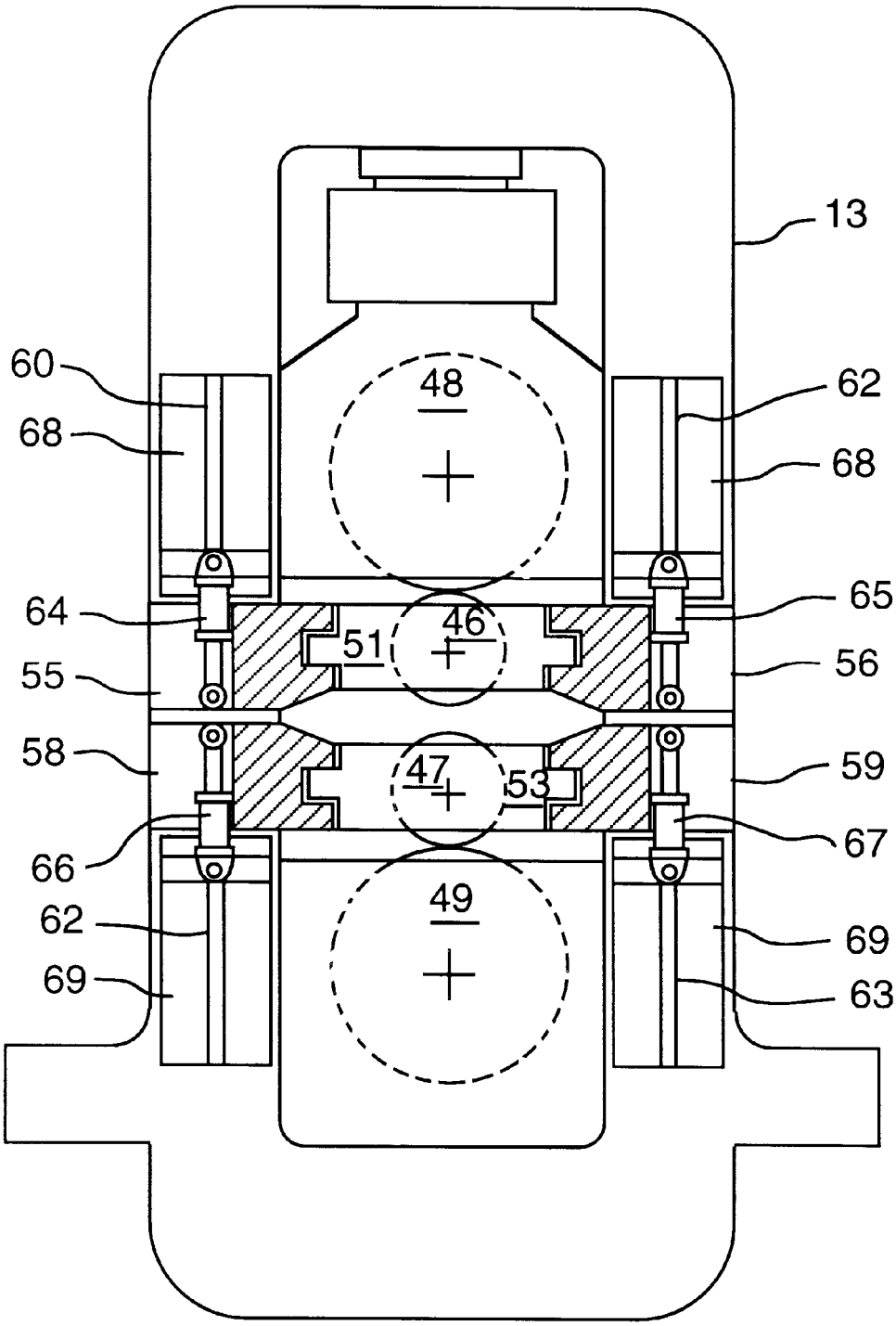
FIG. 5 is a side elevational view of the rolling mill depicted in FIG. 4.
Figure 6:
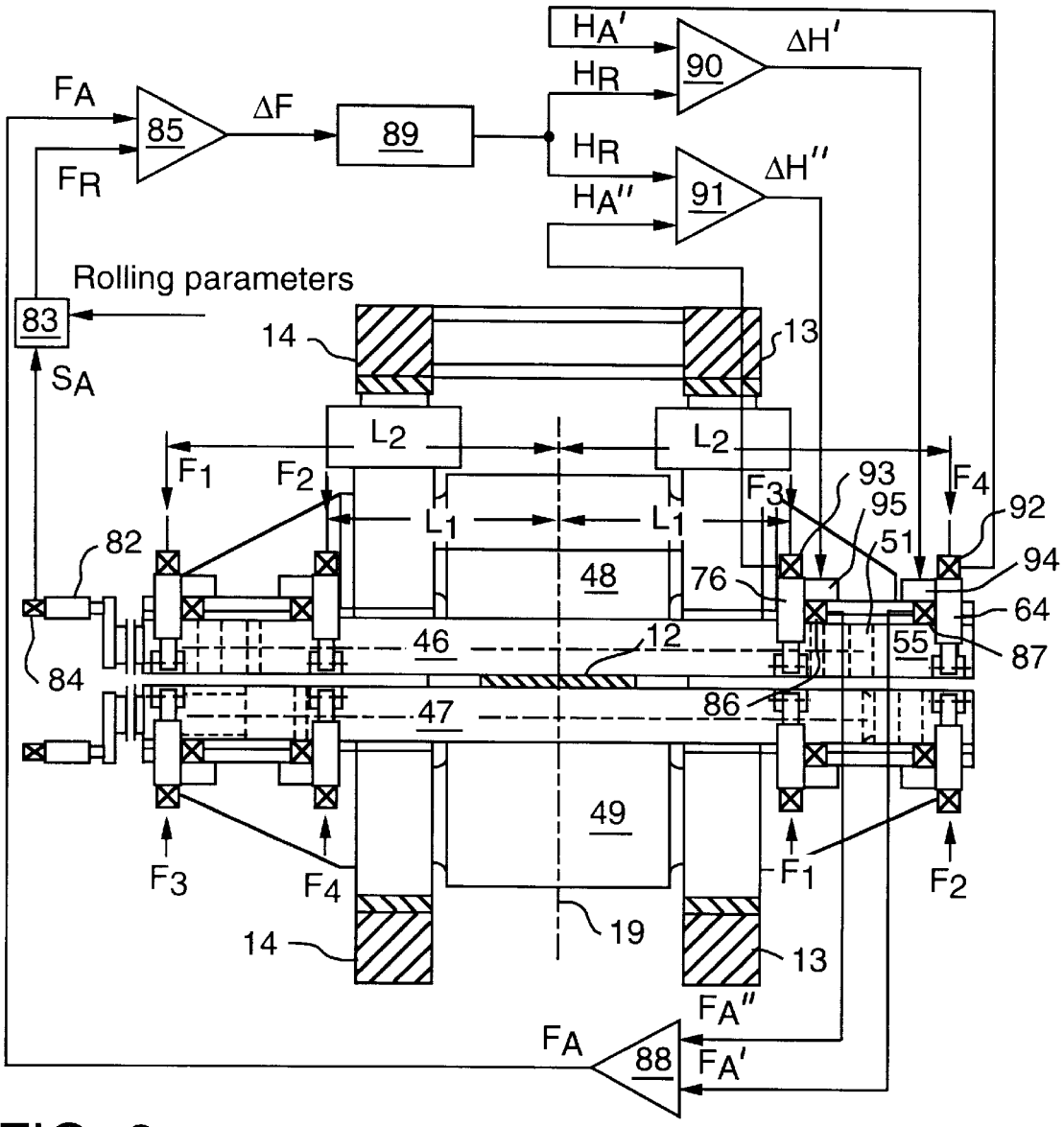
FIG. 6 is a front elevational view in partial cross section of the rolling mill depicted in FIG. 4 for schematically describing a work roll bending cylinder control system of the invention.

Another embodiment of the invention is depicted in FIGS. 4, 5, and 6. In such embodiment, differing means are provided to exert roll bending forces through work roll chocks as such rolls rotate and shift axially during continuous metal strip processing. Referring to FIGS. 4 and 5, rolling mill housing posts 13 and 14 support upper and lower work rolls 46 and 47, and associated backup rolls 48 and 49, for thickness gauge reduction processing of strip 12. Such work rolls are of a length substantially greater than a width of the metal strip 12. Associated with upper work roll 46 are chocks 50 and 51, and with lower work roll 47, are chocks 52 and 53.

In the present embodiment, FIGS. 4 and 5, hydraulic cylinder assemblies for exerting work roll bending forces remain stationary, that is they do not move laterally as the work rolls shift axially in the direction of their longitudinal axes. To carry out such work roll bending, force is applied to the chocks (which move laterally with the work rolls) through elongated grippers such as 54, 55, 56, 57, 58 and 59 which slideably engage chocks 50, 51, 52 and 53. Such chock and gripper arrangement is best seen in FIG. 5, wherein chock 51 is slideably engaged by grippers 55 and 56 and chock 53 is slideably engaged by grippers 58 and 59.

Work roll bending is achieved by adjusting such grippers in a vertical direction which in turn exerts bending force to associated chocks. Such elongated grippers maintain substantially vertical force on the chocks as the chocks move laterally along the grippers in direct relationship with work roll axial shifting. Adjustment of the grippers in solely a vertical direction is assured by guiding pins 60, 61, 62, 63 best seen in FIG. 5. Each hydraulic cylinder assembly (cylinder and piston) bears at one of its ends on a gripper and at its opposite end on a bracket. For example cylinder assembly 64, in FIG. 5, bears at one of its ends on its associated gripper 55 and at its opposite end on its associated bracket 68. In a similar manner cylinder assemblies 65, 66 and 67 bear on their associate grippers and brackets. Such brackets, positioned on both the operator side and drive side of the rolling mill, are best seen in FIG. 4 at 68, 69, 70, and 71.

In a preferred embodiment each gripper is adjusted, in the vertical direction, by a pair of hydraulic cylinder assemblies. Such cylinder pairs are indicated as 64 and 76, 66 and 77, 72 and 73, and 74 and 75 in FIG. 4. For proper operation of such roll bending apparatus each pair of cylinder assemblies, for example cylinder assemblies 64 and 76, associated with gripper 55, move such that an engaging surface of the elongated gripper remains substantially horizontally oriented as it is adjusted in the vertical direction. Controls to assure such horizontal orientation form a part of the present invention and are described below.

Such slideable engagement of work roll chocks and their associated grippers enables lateral movement of the chocks along the grippers in direct relationship with axial shifting of the rolls. Roll bending forces are exerted on the chocks and transferred through a centerline of each rolls bearings in a manner preferred for optimum bearing performance and useful bearing life. Such application of force through the centerline of each bearing is facilitated through use of solely line contact between the chocks and their associated grippers. Such line contact prevents any twisting force on the bearings and contributes to longer bearing life.

Such paired hydraulic cylinder assemblies, for example 64 and 76 (FIG. 4), exert forces indicated at $F_3$ and $F_4$ on opposite ends of gripper 55; and cylinders 66 and 77, exert forces indicated at $F_1$ and $F_2$ on opposite ends of gripper 58. Similarly paired arrangements are present for all eight grippers of a rolling system of the invention. Adjustment of the grippers in a vertical direction applies bending force through the chocks to the work rolls. Bending force on the right end of upper work roll 46 (as shown in FIG. 4) is the sum of bending forces $F_3$ and $F_4$. Lever length of such sum of forces is dependent on chock position along the elongated grippers. Such lever length has a maximum length of $L_4$ and a minimum length of $L_3$. Such lengths are measured between force application points and central plane 19 of the rolling mill. Similar lever lengths and forces are present at the left end of lower work roll 47 when upper and lower work rolls are axially shifted in opposite directions, an equal distance from rolling mill central plane 19. A similar analysis can be made for the left end of upper work roll 46 and the right end of lower work roll 47. In such later example $L_3$ and $L_4$ are substantially the same length as in the first example, however, $F_1$ and $F_2$ would differ from $F_3$ and $F_4$ due to a differing position of the chocks along their associated elongated grippers. Even when a chock is at a minimum distance from central plane 19 (approximately $L_3$) it presents a lever length longer than $L_g$ which is found in prior art rolling mills.

Placement of work roll chocks and associated roll bending apparatus outside of mill housing posts 13 and 14 enables placement of roll dressing means such as grinders, roll surface hardening means and cooling means at a preferred location. In both embodiments described above, such grinders are shown placed within housing posts 13 and 14 and outside the working zone. Such locations are indicated at 78, 79, 80, and 81 of FIGS. 2 and 4. Such locations avoid the unfavorable environment existing in the working zone between housing posts 13 and 14 as depicted in the prior art rolling mill of FIG. 1. Also, such locations position the grinders closer to central plane 19 compared with locations disclosed in parent application Ser. No. 09/113,997. Roll dressing location in the parent application is outside of the mill housing posts in directions away from the working zone. The location taught by the present invention enables use of shorter work rolls, as axial shifting requirements of each roll, to dress a central portion of each roll, is reduced. Such location can be used for roll hardening and cooling apparatus as well as roll grinders.

As discussed above, in relation to the embodiment of the invention depicted in FIGS. 4, 5 and 6, hydraulic cylinder assemblies to vertically adjust the elongated grippers are stationary relative to lateral movement during work roll axial shifting. Controls to maintain substantially horizontal orientation of engaging surfaces of the grippers is an important contribution of the invention. Such horizontal orientation is maintained to assure a parallel relationship of engaging surfaces of grippers associated with a common chock. Such system control is described with reference to FIG. 6 where mill housing posts are depicted at 13 and 14 supporting work rolls 46 and 47 and associated backup rolls 48 and 49 for thickness gauge reduction of continuous strip 12. For purposes of disclosing the system controls, control of hydraulic cylinders 64 and 76, forming a cylinder pair for gripper 55, is described. It is to be understood that such control is applicable to the remaining pairs of hydraulic cylinders for each of the grippers providing work roll bending during rolling operations.

Hydraulic cylinder assemblies 64 and 76 are associated with gripper 55 to exert a bending force to one end of upper work roll 46. Axial shifting of such work roll is actuated by roll shifting hydraulic cylinder assembly 82. As the work roll shifts axially and roll bending force is applied, forces $F_3$ and $F_4$ are controllably adjusted to compensate for a changing lever length as measured from central plane 19 to chock 51. Such compensation is required to maintain a pre-determined cross-sectional profile along the entire length of the continuous strip being processed. In the course of regulating forces $F_3$ and $F_4$ horizontal orientation of the engaging surface of elongated gripper 55 is maintained by such controls.

Rolling parameters for such cross-sectional profiling are pre-determined for the specific continuous strip material to be processed and are input to roll bending pressure reference generator 83. Such parameters together with the axial position of the work roll generated by position transducer 84 on roll shifting cylinder 82 enable operation of the control system. Position transducer 84 sends roll shifting signal $S_A$ to generator 83. Pressure reference $F_R$, the determined roll bending force to be applied to the chock under current conditions, is sent to roll bending pressure controller 85. Controller 85 compares $F_R$ with actual pressure $F_A$ which is obtained by adding actual pressures $F_A'$ and $F_A''$ measured by pressure transducers 86 and 87 associated respectively with roll bending cylinders 76 and 64. Adding of pressures $F_A'$ and $F_A''$ is carried out by pressure sum unit 88. A difference between actual pressure $F_A$ and required pressure $F_R$ designated $\Delta F$ is input from controller 85 to cylinder position reference generator 89. Generator 89 converts pressure error signal $\Delta F$ into bending cylinder position reference $H_R$. $H_R$ is compared by roll bending cylinder position regulators 90 and 91 with actual cylinder position signals $H_A'$ and $H_A''$ generated by respective cylinder position transducers 92 and 93. The cylinder position difference is referred to as position error. Position error signals are indicated as $\Delta H'$ for cylinder 64 and $\Delta H''$ for cylinder 76. Signals $\Delta H'$ and $\Delta H''$, after amplification, are sent to respective servovalves 94 and 95 to control flow of hydraulic fluid in or out of each hydraulic cylinder in order to maintain such horizontal orientation of the engaging surface of the elongated gripper.

While specific components and process steps have been set forth for purposes of describing the preferred embodiments of the invention, various modifications can be resorted to, in light of the above teachings, without departing from applicant's novel contributions. Therefore, in determining the scope of the invention, reference shall be made to the appended claims.

What is claimed is:

1. A continuous spiral motion system for rolling elongated metal strip between work rolls supported in a rolling mill stand, including a pair of mill housing posts which define a working zone, comprising:

an upper and a lower work roll, each of a length substantially greater than a width of the metal strip to be rolled and each having bearing means within chocks at each end of each roll, a backup roll associated with each work roll, shifting means to continuously axially shift the work rolls during rolling of the strip, such that with a rotating motion of the work rolls, a spiral rolling motion of the work rolls, in relation to the rolled strip, is provided, bending means for exerting work roll bending force through a centerline of each bearing within said work roll chocks to achieve work roll bending during spiral motion rolling of the metal strip, and in-line roll dressing means located outside of the working zone and within said mill housing posts.

2. The continuous spiral motion rolling system of claim 1, including hydraulic cylinder assemblies which exert bending forces for said bending of the work rolls.

3. The continuous spiral motion rolling system of claim 2, wherein said hydraulic cylinder assemblies for exerting work roll bending force move laterally in direct relationship with axial shifting of associated work rolls.

4. The continuous spiral motion rolling system of claim 2, wherein said hydraulic cylinder assemblies for exerting work roll bending force through work roll chocks are disposed at a stationary location in relation to lateral movement.

5. The continuous spiral motion rolling system of claim 4, wherein said work roll chocks are slideably engaged in elongated grippers, and each such gripper is adjustable in a vertical direction by a pair of hydraulic cylinders, one cylinder bearing at each of its ends, and said vertical adjustment exerts bending force to the work roll through its chocks.

6. The continuous spiral motion rolling system of claim 5, further comprising:

a control system for each pair of hydraulic cylinder assemblies to provide vertical adjustment of said elongated gripper, whereby horizontal orientation of an engaging surface of the gripper is continually maintained during said vertical adjustment in order that engaging surfaces of grippers for upper work roll chocks and engaging surfaces of grippers for lower work roll chocks are maintained in parallel relationship.

7. The continuous spiral motion rolling system of claim 6, wherein said control system includes:

a work roll bending pressure reference generator, for storing rolling parameters, a work roll shifting cylinder position transducer, for determining lateral position of the work roll, work roll bending pressure transducers, for determining actual work roll bending forces, a bending pressure sum unit, for adding such actual bending forces, a work roll bending pressure controller, for comparing said added actual bending forces with said stored rolling parameters, a work roll bending cylinder position reference generator for converting said added actual bending forces and said stored rolling parameters into roll bending cylinder position references, work roll bending cylinder position transducers, for determining actual positions of work roll bending cylinders, work roll bending cylinder position regulators, for comparing said actual positions of roll bending cylinders with said roll bending cylinder position references, to determine work roll bending cylinder position errors, and hydraulic fluid servovalves for controlling fluid flow in and out of each roll bending hydraulic cylinder assembly to correct said position errors so as to maintain the horizontal orientation of engaging surfaces of the elongated grippers during vertical adjustment thereof.

8. The continuous spiral motion rolling system of claim 3, further comprising:

housings for said laterally moveable hydraulic cylinder assemblies and retainers rigidly mounted to said mill stand to slideably engage a bearing surface of said housings to enable work roll bending during the rolling process.

9. The continuous spiral motion rolling system of claim 1, wherein said work roll dressing means consists of grinding apparatus, work roll hardening apparatus and work roll cooling apparatus.

10. A method for rolling elongated metal strip for thickness gauge reduction between mill stand supported upper and lower work rolls having a continuous spiral motion, in relation to the metal strip, comprising:

providing a rolling mill stand for supporting an upper and lower work roll of a length substantially greater than a width of the metal strip to be rolled, a back up roll associated with each such work roll, and a rotationally supporting chock at each end of such work rolls, said rolling mill stand including mill housing posts which define a working zone, shifting each work roll in the direction of its longitudinal axis to impart a spiral motion with respect to the strip during thickness gauge reduction, exerting bending forces to said work rolls through said work roll chocks to enable strip profiling, providing work roll dressing means outside the working zone and within mill housing posts of the mill stand, and dressing said work rolls concurrently with such rolling operation.

11. The method of claim 10 for rolling elongated metal strip, further comprising:

exerting said work roll bending force by action of hydraulic cylinder assemblies.

12. The method of claim 11 for rolling elongated metal strip, further comprising:

laterally moving said hydraulic cylinder assemblies, for applying bending forces to the work rolls, in direct relationship with axial shifting of associated work rolls.

13. The method of claim 11 for rolling elongated metal strip, further comprising:

disposing said hydraulic cylinder assemblies for exerting bending forces to the work rolls at stationary locations in relation to lateral movement.

14. The method of claim 13 for rolling elongated metal strip, further including:

slideably engaging said work roll chocks with the elongated grippers, adjustable in a vertical direction by said hydraulic cylinder assemblies bearing at each end of each gripper, for exerting bending force to the work rolls.

15. The method of claim 14, for rolling elongated metal strip, further comprising:

providing a control system for the hydraulic cylinder assemblies exerting force on the elongated grippers, and controlling the vertical adjustment of said grippers to maintain substantially horizontal orientation of an engaging surface of each elongated gripper throughout its vertical adjustment.

16. The method of claim 12 for rolling elongated metal strip, further comprising:

housing said laterally moving hydraulic cylinders in a housing, and retaining said housing with a retainer rigidly mounted to said mill stand by slideably engaging bearing surfaces of said housing to carry out bending of said work rolls.

17. A continuous elongated metal strip, produced by the method of claim 10.

* * * * *

UNITED STATES PATENT AND TRADEMARK OFFICE

CERTIFICATE OF CORRECTION

PATENT NO. : 6,029,491
DATED : February 29, 2000
INVENTOR(S) : Vladimir B. Ginzburg It is certified that error appears in the above-identified patent and that said Letters Patent is hereby corrected as shown below:

On the title page, item [54] and col. 1, lines 1-2 should read.

CONTINUOUS SPIRAL MOTION AND ROLL
BENDING SYSTEM FOR ROLLING MILLS

Signed and Sealed this

Fifth Day of December, 2000

*Attest:*

*Attesting Officer*

Q. TODD DICKINSON

*Director of Patents and Trademarks*